US011624999B2

(12) United States Patent
Ohashi

(10) Patent No.: US 11,624,999 B2
(45) Date of Patent: Apr. 11, 2023

(54) IMAGE FORMING APPARATUS

(71) Applicant: KYOCERA Document Solutions Inc., Osaka (JP)

(72) Inventor: Hiroaki Ohashi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/751,308

(22) Filed: May 23, 2022

(65) Prior Publication Data

US 2022/0382209 A1 Dec. 1, 2022

(30) Foreign Application Priority Data

May 28, 2021 (JP) ..... JP2021-090057

(51) Int. Cl.
*G03G 21/16* (2006.01)

(52) U.S. Cl.
CPC ..... *G03G 21/1647* (2013.01); *G03G 21/1633* (2013.01); *G03G 21/1671* (2013.01)

(58) Field of Classification Search
CPC ..... G03G 21/1647; G03G 21/1671; G03G 21/1676; G03G 21/1633; G03G 2221/1684; G03G 2221/1869
See application file for complete search history.

(56) References Cited

U.S. PATENT DOCUMENTS

2014/0348536 A1* 11/2014 Ohashi ..... G03G 21/1647 399/119
2015/0362889 A1 12/2015 Ohashi et al.

FOREIGN PATENT DOCUMENTS

JP 2016-014854 A 1/2016

* cited by examiner

*Primary Examiner* — Sophia S Chen
(74) *Attorney, Agent, or Firm* — Studebaker & Brackett PC

(57) ABSTRACT

An image forming apparatus includes an image carrier unit, a developing unit, a supporting frame, a retainer and a sheet member. The image carrier unit includes an image carrier on which an electrostatic latent image is formed. The developing unit develops the electrostatic latent image with toner. The supporting frame supports the image carrier unit and the developing unit in an attachable and detachable manner. The retainer is supported by the supporting frame in a turnable manner, and positions the image carrier unit and the developing unit to the supporting frame by being turned upward. The sheet member closes a gap between the supporting frame and the retainer. The sheet member has an upper section supported by the retainer and a lower end section supported by the supporting frame, and at least one of the upper end section and the lower end section is configured to be detachable.

7 Claims, 9 Drawing Sheets

IMAGE FORMING APPARATUS

INCORPORATION BY REFERENCE

This application is based on and claims the benefit of priority from Japanese patent application No. 2021-090057 filed on May 28, 2021, which is incorporated by reference in its entirety.

BACKGROUND

The present disclosure relates to an image carrier unit and an image forming apparatus including the image carrier unit.

In an electrophotographic image forming apparatus, a toner image is formed on an image carrier by developing an electrostatic latent image formed on the image carrier with toner. The image forming apparatus may be configured such that an image carrier unit including the image carrier and a developing unit which develops the electrostatic latent image with the toner are detachably supported on a support frame. The image forming apparatus includes a retainer for positioning the image carrier unit and the developing unit on the support frame.

The image carrier unit and the developing unit are attached and detached through an opening formed in the front side plate of the support frame. The lower end of the retainer is turnably supported by the support frame below the opening. By turning the retainer upward and fixing it to the support frame, the retainer positions both units to the support frame.

In the image forming apparatus described above, the toner scattered from the image carrier unit and the developing unit may leak out to the outside of the image forming apparatus through the opening and the gap between the lower end of the retainer and the support frame.

On the other hand, a sheet member may be provided to close the gap between the lower end of the retainer and the support frame. For example, the sheet member is fixed to the retainer with a double-side tape above the gap, and fixed to the support frame below the gap with a double-side tape. In this case, when the retainer is detached, the sheet member also needs to be removed, and there is a problem that the work takes time and waste members are generated.

SUMMARY

In accordance with one aspect of the present disclosure, an image forming apparatus includes an image carrier unit, a developing unit, a supporting frame, a retainer and a sheet member. The image carrier unit includes an image carrier on which an electrostatic latent image is formed. The developing unit develops the electrostatic latent image formed on the image carrier with toner. The supporting frame supports the image carrier unit and the developing unit in an attachable and detachable manner. The retainer is supported by the supporting frame in a turnable manner, and positions the image carrier unit and the developing unit to the supporting frame by being turned upward. The sheet member closes a gap between the supporting frame and the retainer. The sheet member has an upper section supported by the retainer and a lower end section supported by the supporting frame, and at least one of the upper end section and the lower end section is configured to be detachable.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to the attached drawings, one embodiment of the present embodiment will be described.

Figure 1:
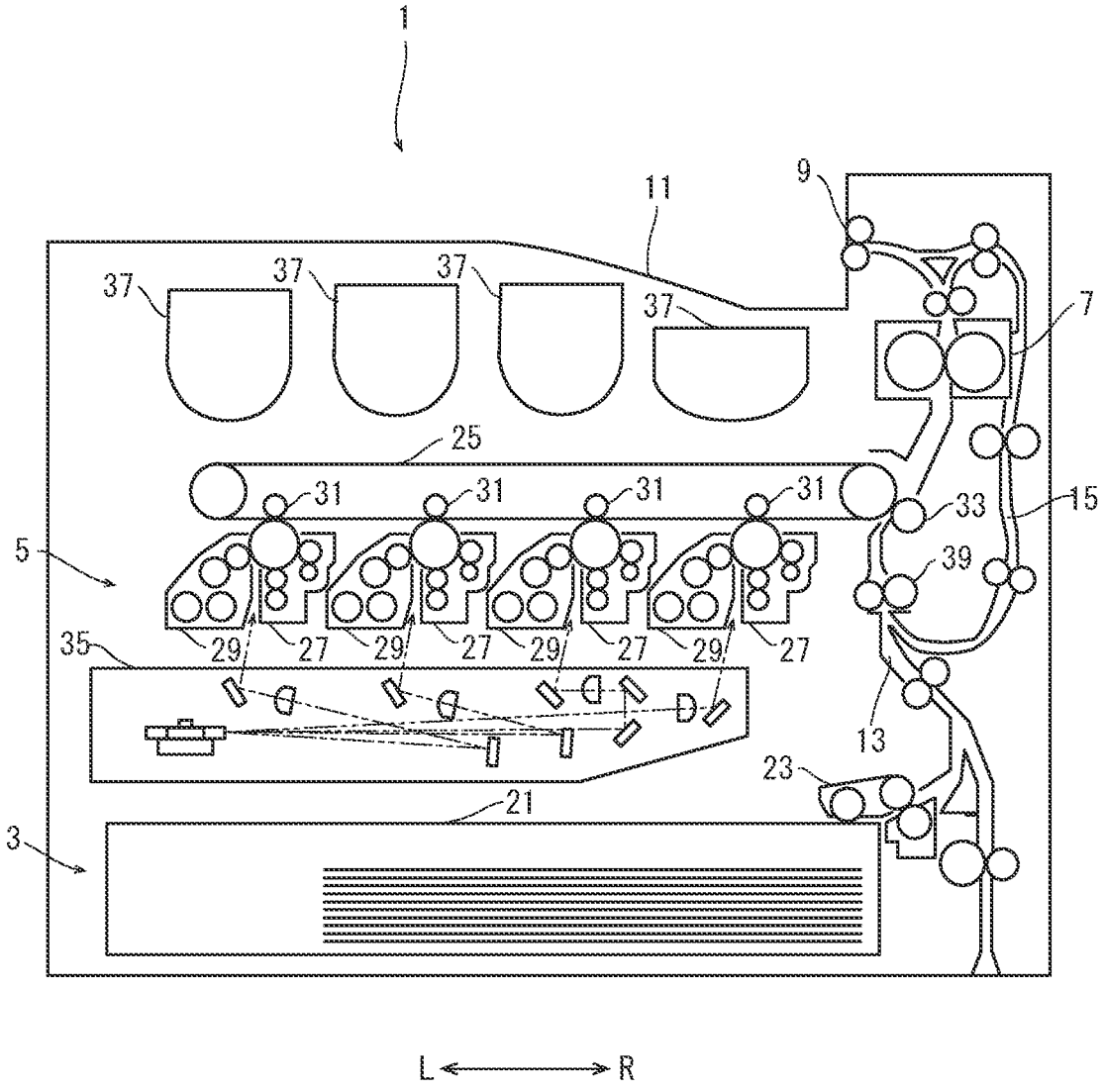
FIG. 1 is a front view schematically showing an inner structure of an image forming apparatus according to one embodiment of the present disclosure.

With reference to FIG. 1, an image forming apparatus 1 will be described. FIG. 1 is a front view schematically showing an inner structure of the image forming apparatus 1. In each of the drawings, Fr, Rr, L, and R indicate the front side, rear side, left side, and right side of the image forming apparatus 1, respectively.

The image forming apparatus 1 includes a sheet feeding part 3, an electrophotographic image forming part 5, a fixing device 7, a discharging device 9, and a discharge tray 11. The image forming apparatus 1 further includes a main conveyance path 13 for a sheet from the sheet feeding part 3 to the discharging device 9 via the image forming part 5 and the fixing device 7, and an inversion path 15 branched from the main conveyance path 13.

The sheet feeding part 3 includes a sheet feeding cassette 21 in which the sheet is stored, and a sheet feeding unit 23 which feeds the sheet from the sheet feeding cassette 21 to the main conveyance path 13.

The image forming part 5 includes an endless intermediate transfer belt 25, four image carrier units 27 and four developing units 29 each corresponding to toner of four colors (yellow, magenta, cyan and black), four primary transfer rollers 31 corresponding to the four image carrier units 27, a secondary transfer roller 33, and an exposure device 35.

The intermediate transfer belt 25 is wound around a driving roller and a driven roller which are disposed apart from each other in the left-and-right direction. As the driving roller rotates, the intermediate transfer belt 25 travels in the counterclockwise direction of FIG. 1.

The four image carrier units 27 are arranged side by side along the traveling direction of the intermediate transfer belt 25 so as to face the lower traveling surface of the belt 25. Each developing unit 29 is disposed adjacently on the upstream side of each image carrier unit 27 in the traveling direction of the intermediate transfer belt 25. The four developing units 29 are connected to toner containers 37 containing the toner of the respective colors. The four primary transfer rollers 31 are disposed in the hollow space of the intermediate transfer belt 25 and face the four image carrier units 27 across the intermediate transfer belt 25. The secondary transfer roller 33 is disposed facing the intermediate transfer belt 25 on the downstream side of the four image carrier units 27 and the four developing units 29 in the traveling direction of the intermediate transfer belt 25. A transfer nip is formed between the secondary transfer roller 33 and the intermediate transfer belt 25. The image carrier unit 27 and the developing unit 29 will be described later.

The exposure device 35 is disposed below the four image carrier units 27 and the four developing units 29, and performs exposure corresponding to image data on the four image carrier units 27.

The fixing device 7 has a pressure roller and a heating roller, and a fixing nip is formed between both rollers.

The main conveyance path 13 is formed from the sheet feeding part 3 to the discharging device 9 through the secondary transfer nip and the fixing nip. On the main conveyance path 13, a registration rollers pair 39 is disposed between the sheet feeding part 3 and the secondary transfer nip. The inversion path 15 is branched from the main conveyance path 13 at a branching portion between the fixing nip and the discharging device 9, and is merged with the main conveyance path 13 at a joining portion between the sheet feeding part 3 and the registration rollers pair 39.

Next, the image forming operation will be briefly described. In an image forming part 5, the image carrier unit 27 forms an electrostatic latent image corresponding to the image data by the exposure by the exposure device 35. The developing unit 29 develops the electrostatic latent image formed on the image carrier unit 27 into a toner image. The toner image of each image carrier unit 27 is transferred to the intermediate transfer belt 25 by the corresponding primary transfer roller 31.

On the other hand, in the sheet feeding part 3, the sheet is conveyed from the sheet feeding cassette 21 to the main conveyance path 13 by the sheet feeding unit 23. The sheet is conveyed to the secondary transfer nip by the registration rollers pair 39 at appropriate timing. In the secondary transfer nip, the toner image formed on the intermediate transfer belt 25 is transferred to the sheet. The sheet is conveyed to the fixing device 7 along the main conveyance path 13, and the toner image is fixed to the sheet at the fixing nip of the fixing device 7. The sheet is further conveyed to the discharging device 9 and discharged to the discharge tray 11 by the discharge device 9.

When a double-side printing is performed, the sheet having the toner image fixed on one surface is conveyed from the main conveyance path 13 to the inversion path 15 at the branching portion and conveyed from the inversion path 15 to the main conveyance path 13 at the merging portion. Thereafter, the sheet is conveyed to the secondary transfer nip by the registration rollers pair 39 at appropriate timing, and a toner image formed on the intermediate transfer belt 25 is transferred to the other surface of the sheet. The sheet is conveyed to the fixing device 7 along the main conveyance path 13, and the toner image is fixed to the sheet in the fixing nip. The sheet is further conveyed to the discharging device 9 and discharged to the discharge tray 11 by the discharging device 9.

Figure 2:
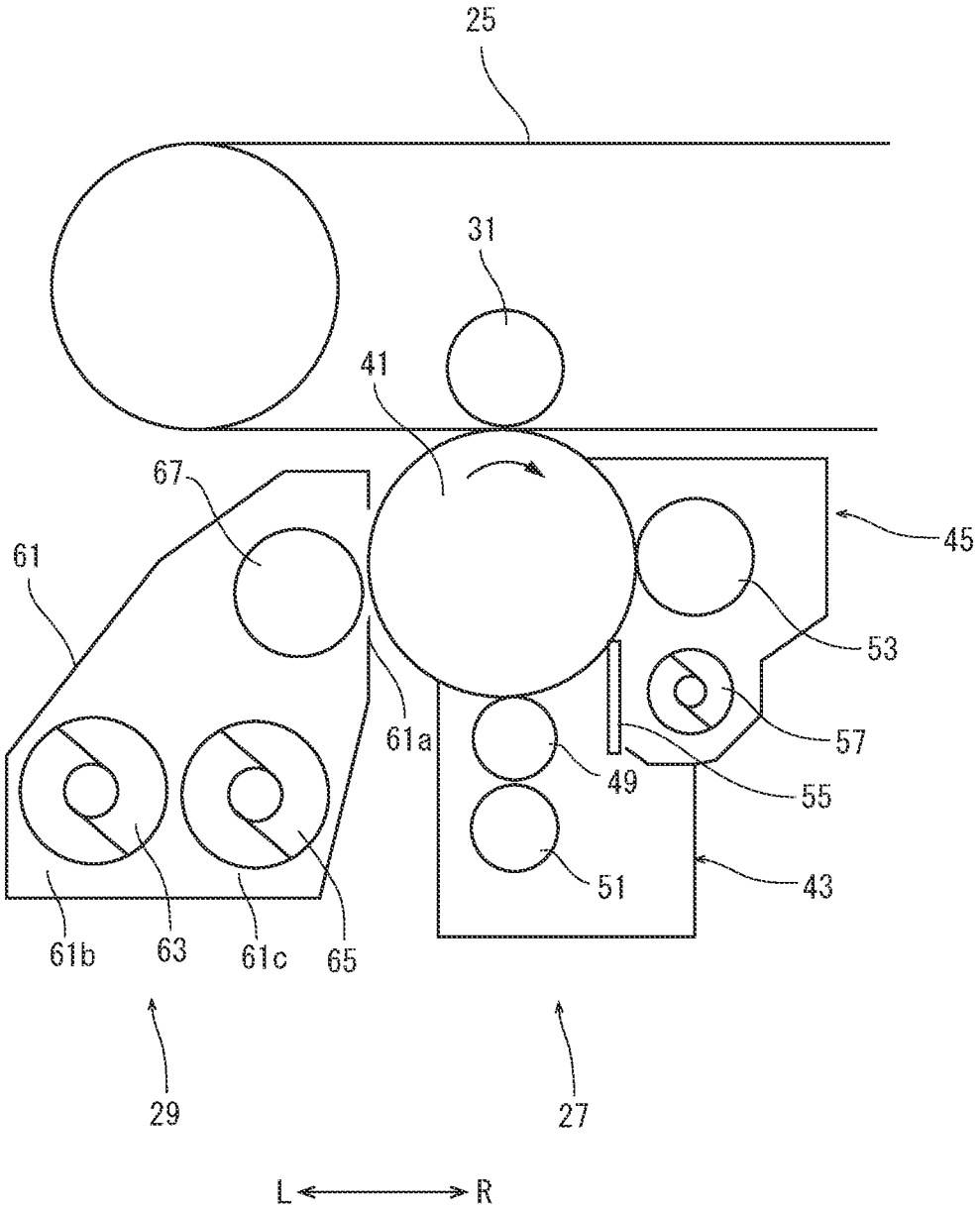
FIG. 2 is a front view schematically showing an image carrier unit and a developing unit of the image forming apparatus according to the embodiment of the present disclosure.
Figure 3:
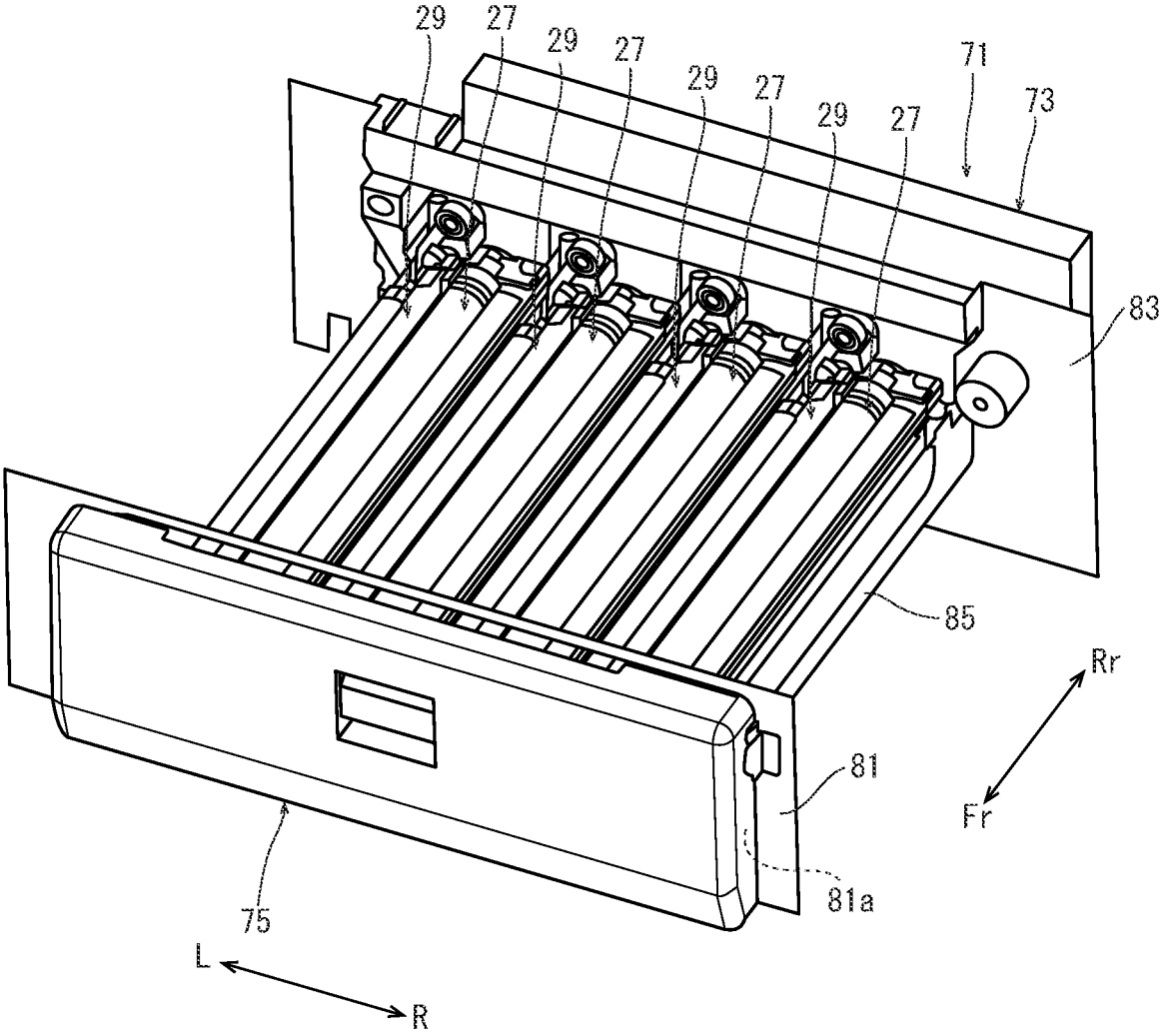
FIG. 3 is a perspective view showing the image carrier unit and the developing unit supported by a supporting frame, in the image forming apparatus according to the embodiment of the present disclosure.

Next, the image carrier unit 27 and the developing unit 29 will be described with reference to FIG. 2 and FIG. 3. FIG. 2 is a front view schematically showing the image carrier unit 27 and the developing unit 29, and FIG. 3 is a perspective view showing the image carrier unit 27 and the developing unit 29 supported by a supporting body 71.

First, the image carrier unit 27 will be described with reference to FIG. 2. The image carrier unit 27 includes a photosensitive drum 41 as an image carrier, a charging device 43, and a cleaning device 45. The photosensitive drum 41 is rotatable in the clockwise direction shown in FIG. 2 around the rotational shaft 41*a*. The charging device 43 and the cleaning device 45 are arranged in order along the rotational direction of the photosensitive drum 41 around the photosensitive drum 41.

The charging device 43 includes a charging roller 49 and a cleaning roller 51. The charging roller 49 rotates in contact with the photosensitive drum 41 and applies a charging bias to the photosensitive drum 41. The cleaning roller 51 rotates in contact with the charging roller 49 and cleans the charging roller 49.

The cleaning device 45 includes a cleaning roller 53, a cleaning blade 55, and a collection roller 57. The cleaning roller 53 rotates in contact with the photosensitive drum 41 and removes the toner remaining on the photosensitive drum 41. The cleaning blade 55 is disposed on the downstream side of the cleaning roller 53 in the rotational direction of the photosensitive drum 41 in contact with the photosensitive drum 41, and scrapes the toner remaining on the photosensitive drum 41. The collection roller 57 conveys the toner removed by the cleaning roller 53 and the cleaning blade 55 toward a collection port (not shown).

Next, the developing unit 29 will be described with reference to FIG. 2. The developing unit 29 includes a developing container 61, an agitating/conveying screw 63, a supplying/conveying screw 65, and a magnetic roller 67.

A developer containing a magnetic carrier and the toner is stored in the developing container 61. The developing container 61 is formed with an opening 61*a* facing the photosensitive drum 41. In the lower space inside the developing container 61, an agitating/conveying chamber 61*b* and a supplying/conveying chamber 61*c* to which the toner is replenished from the toner container 37 (see FIG. 1) are formed. The agitating/conveying screw 63 is rotatably supported by the agitating/conveying chamber 61*a*, and the supplying/conveying screw 65 is rotatably supported by the supplying/conveying chamber 61*b*. The magnetic roller 67 is disposed above the supplying/conveying screw 65, and a part of its outer peripheral surface is exposed through the opening 61*a* of the developing container 61.

As described above, the developing unit 29 is disposed on the upstream side of the image carrier unit 27 in the traveling direction of the intermediate transfer belt 25, and the magnetic roller 67 exposed through the opening 61*a* of the developing container 61 faces the photosensitive drum 41 of the image carrier unit 27.

In the image carrier unit 27, the photosensitive drum 41 is charged to a predetermined potential by the charging device 43. Thereafter, the photosensitive drum 41 is exposed by the exposure device 35 (see FIG. 1) to form the electrostatic latent image based on the image data.

In the developing unit 29, the developer is agitated in the agitating/conveying chamber 61*b* and the supplying/conveying chamber 61*c* by the agitating/conveying screw 63 and the supplying/conveying screw 65 while circulating in both chambers, and the toner is charged. The developer containing the charged toner is conveyed to the magnetic roller 67 by the supplying/conveying screw 65, and a magnetic brush is formed on the magnetic roller 67.

The toner in the magnetic brush formed on the magnetic roller 67 flies from the magnetic roller 67 to the photosensitive drum 41 due to the potential difference between the bias potential applied to the magnetic roller 67 and the potential of the electrostatic latent image on the photosensitive drum 41 in the opening 61*a* of the developing container 61, and the electrostatic latent image on the photosensitive drum 41 is developed with the toner into the toner image.

The toner image formed on the photosensitive drum 41 is transferred to the intermediate transfer belt 25 by the primary transfer roller 31. The toner remaining on the photosensitive drum 41 after the toner image is transferred to the intermediate transfer belt 25 is removed by the cleaning device 45.

As shown in FIG. 3, the four image carrier units 27 and the four developing units 29 are supported and positioned to the supporting body 71. The supporting body 71 includes a supporting frame 73 which supports the units, and a retainer 75 which positions the units on the supporting frame 73.

Figure 4:
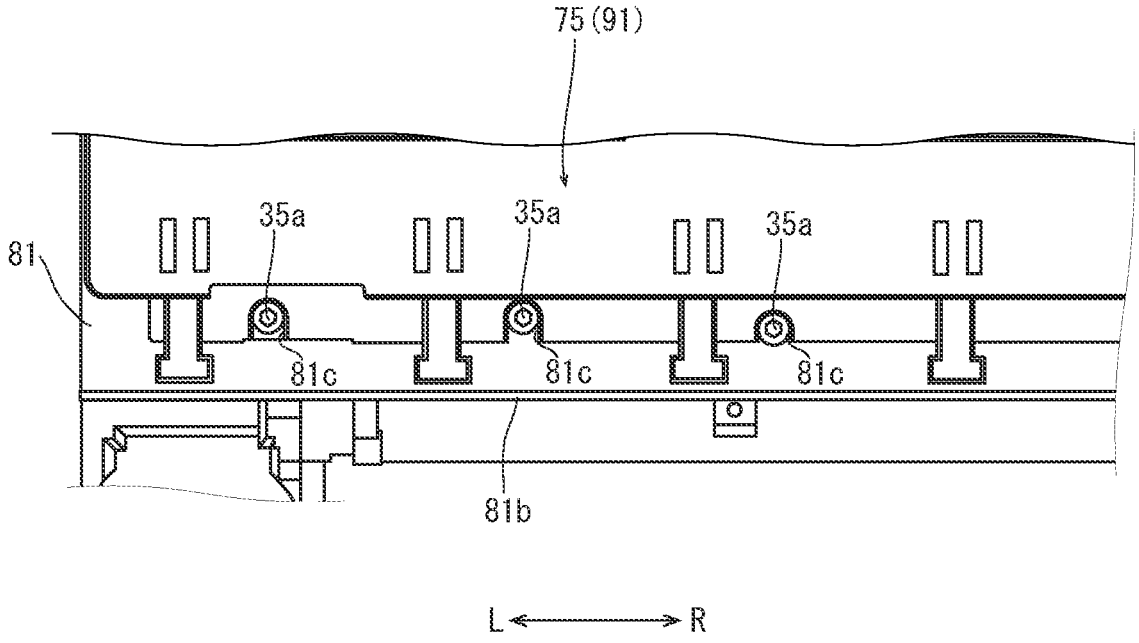
FIG. 4 is a front view showing a reflection mirror adjustment hole of the supporting frame, in the image forming apparatus according to the embodiment of the present disclosure.
Figure 5A:
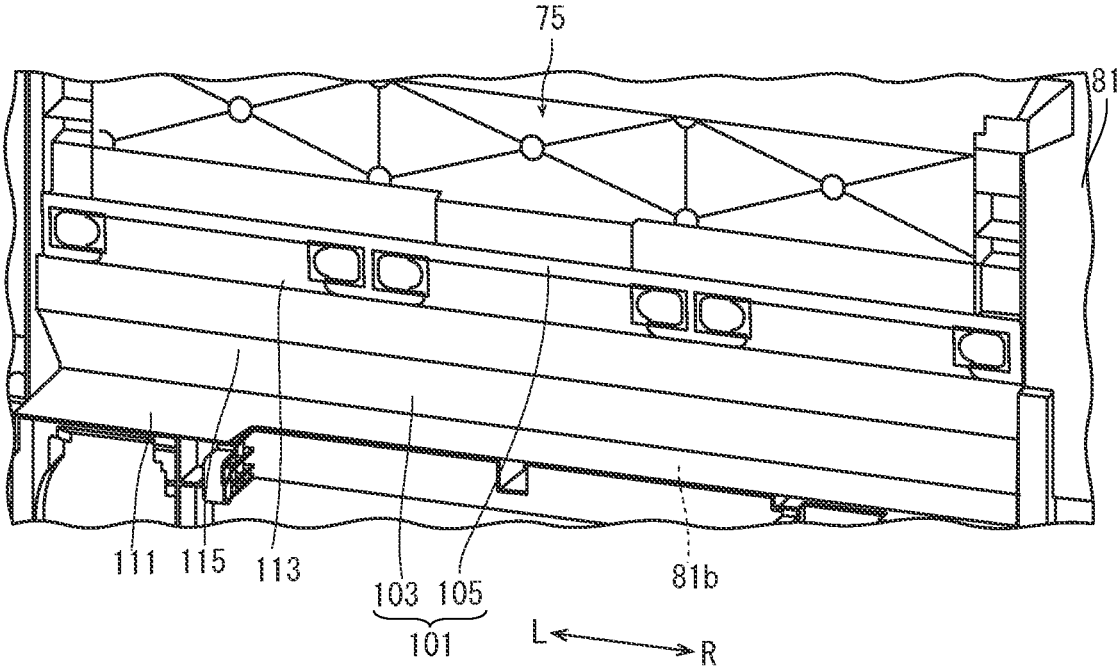
FIG. 5A is a perspective view showing a retainer turned to a positioning position, in the image forming apparatus according to the embodiment of the present disclosure.
Figure 5B:
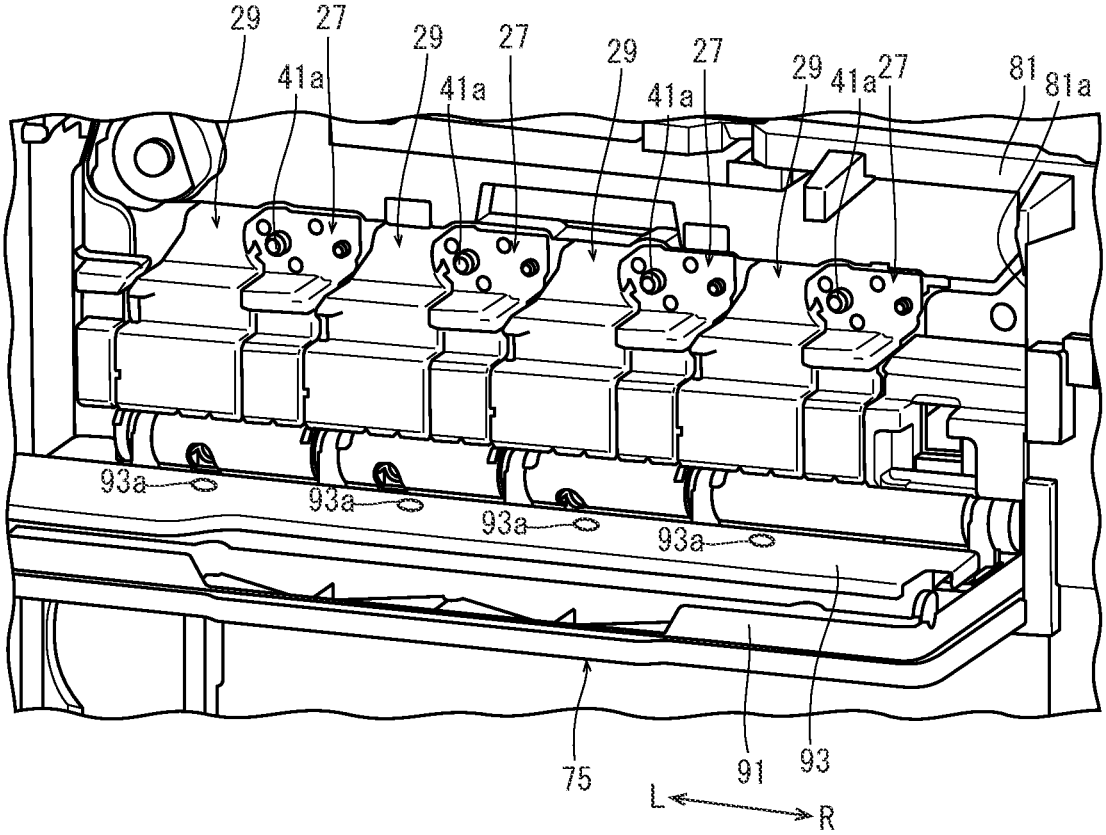
FIG. 5B is a perspective view showing the retainer turned to an opened position, in the image forming apparatus according to the embodiment of the present disclosure.
Figure 6A:
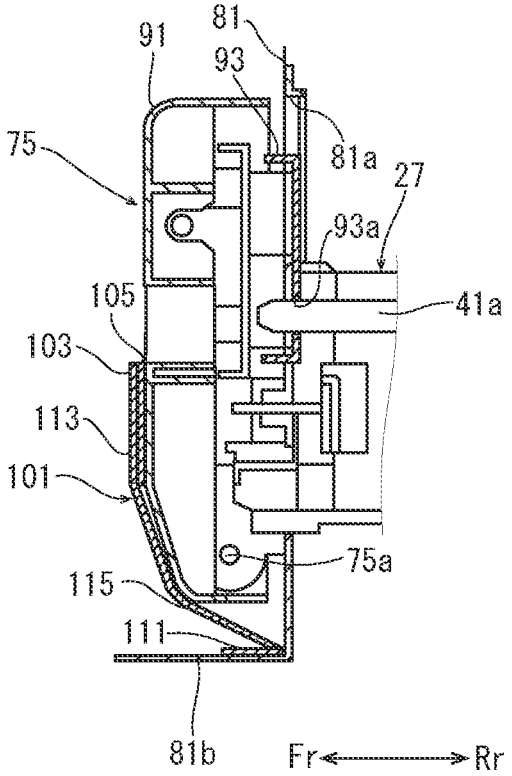
FIG. 6A is a side view showing the retainer turned to the positioning position, in the image forming apparatus according to the embodiment of the present disclosure.
Figure 6B:
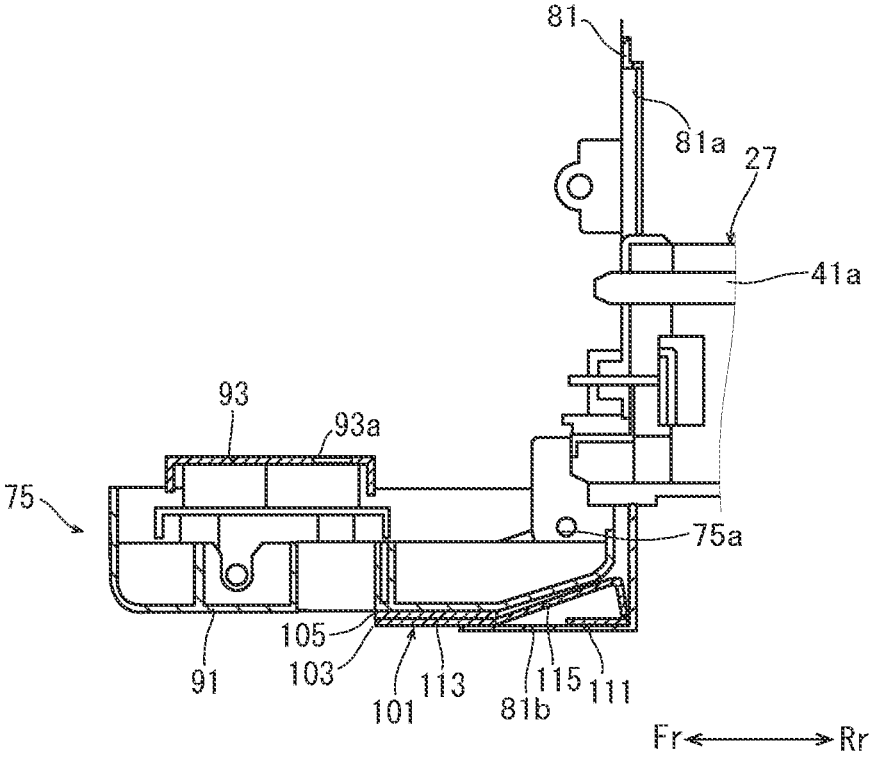
FIG. 6B is a perspective view showing the retainer turned to the opened position, in the image forming apparatus according to the embodiment of the present disclosure.

The supporting body 71 will be described with reference to FIG. 3 and also to FIG. 4, FIG. 5A and FIG. 5B, FIG. 6A and FIG. 6B. FIG. 4 is a front view showing a front frame 81 of the supporting body 71, FIG. 5A and FIG. 5B are perspective views showing the retainer 75, and FIG. 6A and FIG. 6B are side views showing the retainer 75.

As shown in FIG. 3, the supporting frame 73 includes the front frame 81 and a rear frame 83 which are arranged to face each other in the front-and-rear direction, and pedestals 85 provided between the front and rear frames 81 and 83 for each unit.

An opening 81*a* is formed in the front frame 81. The four image carrier units 27 and the four developing units 29 are supported on the corresponding pedestals 85 between the front and rear frames 81 and 83. The four image carrier units 27 and the four developing units 29 are detachable from the corresponding pedestals 85 through the openings 81*a* of the front frame 81. Lock pins (not shown) are provided on the left and right sides of the opening 81*a* of the front frame 81. Further, the front frame 81 is provided with a horizontal supporting piece 81*b* (see FIG. 4, FIG. 5A, FIG. 6A and FIG. 6B) extending forward from below the opening 81*a*.

Further, as shown in FIG. 4, below the opening 81*a* and above the supporting piece 81*b*, the front frame 81 has a plurality of holes 81*c* through which adjusting screws 35*a* for adjusting an angle of reflection mirrors included in the exposure device 35 (see FIG. 1) are exposed. When the angle of the reflecting mirror is adjusted, a tool such as a screwdriver is inserted through the hole 81*c* to rotate the adjusting screw 35*a*.

Next, the retainer 75 will be described. As shown in FIG. 3, the retainer 75 is a plate-like member having a size larger than the opening 81*a* of the front frame 81 of the supporting frame 73, and includes an outer cover 91 and a positioning plate 93 fixed on the inner surface of the outer cover 91, as shown in FIG. 5B, FIG. 6A, and FIG. 6B. Hooks (not shown) are formed on the left and right edges of the outer cover 91. The positioning plate 93 is formed with bearing holes 93*a* into which one ends (front ends) of the rotational shafts 41*a* of the photosensitive drums 41 of the image carrier units 27 can be fitted. As an example, the outer cover 91 is made of resin and the positioning plate 93 is made of sheet metal.

The right and left lower corners of the retainer 75 are supported by the front frame 81 below the opening 81*a* and above the supporting piece 81*b* so as to be rotatable around the rotational shaft 75*a* (see FIG. 6A and FIG. 6B). As a result, the retainer 75 is turned around the rotational shaft 75*a* between a positioning position (see FIG. 5A and FIG. 6A) at which the image carrier units 27 are positioned and an opened position (see FIG. 5B and FIG. 6B) at which the image carrier units 27 and the developing units 29 can be detached. When the retainer 75 is turned to the positioning position, as shown in FIG. 6A, the front end of the rotational shaft 41*a* of the photosensitive drum 41 of the image carrier unit 27 is fitted into the corresponding bearing hole 93*a* of the positioning plate 93, so that the image carrier units 27 are positioned to the supporting frame 73. Similarly, the developing units 29 are positioned to the supporting frame 73. Further, the hooks of the outer cover 91 engages the lock pins of the front frame 81 to maintain the retainer 75 at the positioning position. On the other hand, when the retainer 75 is turned to the opened position, the image carrier units 27 and the developing units 29 can be detached through the opening 81*a*. The retainer 75 is supported on the supporting piece 81*b* of the front frame 81.

When the image forming operation is performed as described above, the toner may scatter from the image carrier units 27 and the developing units 29 and leak out from the gap between each unit and the opening 81*a* of the front frame 81. The leaked toner may be deposited on the supporting piece 81*b* of the front frame 81 or scattered into the inside.

Figure 7:
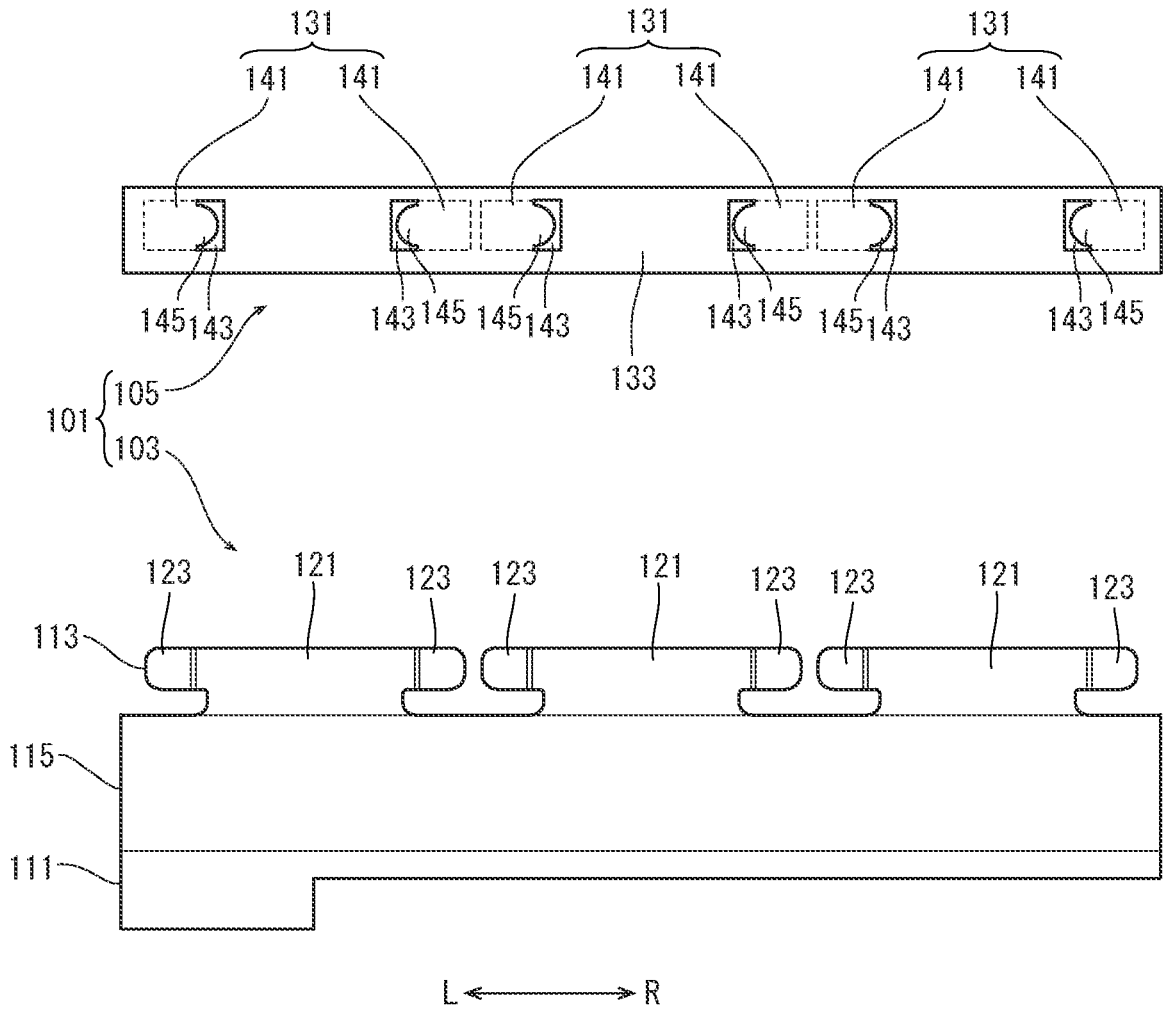
FIG. 7 is a plan view showing a sheet member, in the image forming apparatus according to the embodiment of the present disclosure.
Figure 8:
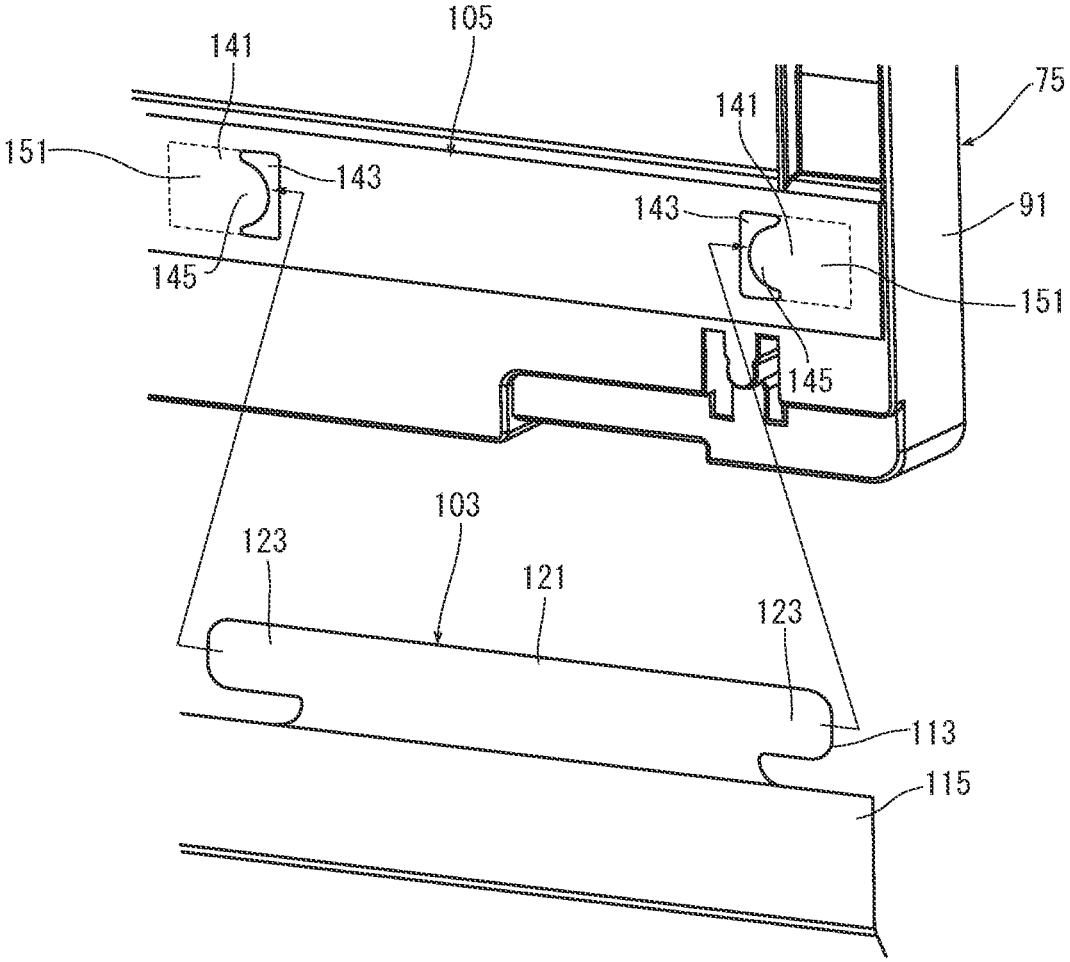
FIG. 8 is a perspective view showing the sheet member, in the image forming apparatus according to the embodiment of the present disclosure.

Therefore, the supporting body 71 is provided with a sheet member 101 which prevents the toner from leaking out through the gap. The sheet member 101 will be described with reference to FIG. 7 and FIG. 8. FIG. 7 is a plan view showing the sheet member 101, and FIG. 8 is a perspective view showing the sheet member 101.

As shown in FIG. 7, the sheet member 101 includes a body side sheet 103 fixed to the supporting frame 73 and a fixed side sheet 105 fixed to the retainer 75. The body side sheet 103 has a substantially rectangular shape long in the left-and-right direction and has a size capable of closing the gap. The body side sheet 103 has a lower end section 111, an upper end section 113 and an intermediate section 115 therebetween. The upper end section 113 includes three flap portions 121 formed at intervals in the left-and-right direction. A pair of right and left rectangular insertion pieces 123 are formed along the left and right side edges of each flap portion 121. The upper and lower corners of each insertion piece 123 are formed in an arc shape. As an example, the upper end section 113 is formed of a sheet piece made of elastic resin, and the intermediate section 115 and the lower end section 111 are formed of a sheet piece made of flexible synthetic leather, nonwoven fabric, or the like, and the upper end section 113 and the intermediate section 115 are connected by using an adhesive or suturing. The body side sheet 103 is also referred to as the sheet member simply.

As shown in FIG. 5A, FIG. 6A, and FIG. 6B, the lower end section 111 of the body side sheet 103 is fixed to the upper surface of the supporting piece 81*b* of the front frame 81 of the supporting frame 73 by using a double-side tape or an adhesive.

As shown in FIG. 7, the fixed side sheet 105 has a rectangular shape long in the left-and-right direction, and has three holding portions 131 corresponding to the three flap portions 121 of the body side sheet 103, and a fixing portion 133 fixed to the retainer 75 other than the three holding portions 131. As an example, the fixed side sheet 105 is formed of an elastic resin sheet piece.

Each holding portion 131 has a pair of right and left rectangular pocket pieces 141. A rectangular slit 143 is formed on the inner sides of the pair of pocket pieces 141 facing each other. A semicircular pressing piece 145 is formed on the inner facing side of the pair of pocket pieces 141.

The fixing portion 133 is fixed to the outer surface of the retainer 75 (the outer cover 91) by using a double-side tape or an adhesive. As a result, as shown in FIG. 8, a pair of pockets 151 opening in the slits 143 are formed between the outer cover 91 and the pair of pocket pieces 141. The insertion piece 123 of each flap portion 121 of the body side sheet 103 can be inserted into the pocket 151 through the slit 143. As described above, the pocket 151 formed between the outer cover 91 and the pocket piece 141 is an example of the insertion hole into which the insertion piece 123 of the body side sheet 103 can be inserted, and the fixed side sheet 105 is an example of the holding member having the insertion hole into which the insertion piece 123 of the body side sheet 103 can be inserted.

As shown in FIG. 5A, FIG. 6A, and FIG. 6B, in the sheet member 101 having the above structure, the lower end section 111 of the main body side sheet 103 is fixed to the upper surface of the supporting piece 81*b* of the front frame 81, and the fixing portion 133 of the fixed side sheet 105 is fixed to the outer cover 91 of the retainer 75. The three pairs of insertion pieces 123 of the body side sheet 103 are inserted into the three pairs of pockets 151 between the fixed side sheet 105 and the outer cover 91. The insertion piece 123 is inserted into the pocket 151 and then pressed against the outer cover 91 by the pressing piece 145. As described above, the lower end section 111 of the main body side sheet 103 is fixed to the front frame 81 below the gap, and the upper end section 113 (the three flap portions 121) is supported by the retainer 75 above the gap, whereby the scattering of the toner leaked through the gap can be prevented.

The intermediate section 115 of the body side sheet 103 is not fixed to the retainer 75 or the front frame 81, so that when the retainer 75 is turned, it is bent depending on the turning of the retainer 75.

On the other hand, when the pair of insertion pieces 123 is drawn out from the pair of pockets 151, the upper end section 113 of the body side sheet 103 can be detached from the fixed side sheet 105, that is from the retainer 75. Accordingly, when the retainer 75 is replaced or when the angle of the reflection mirror of the exposure device 35 (see FIG. 1) is adjusted, the insertion pieces 123 are drawn out from the pockets 151, and the upper end section 113 of the body side sheet 103 is detached from the retainer 75.

As described above, according to the present disclosure, when the retainer 75 is replaced or when the angle of the reflection mirror is adjusted, it is not required to detach the sheet member 101 completely. Therefore, it becomes possible to replace the retainer 75 or to adjust the angle of the reflection mirror without generating the waste and to prevent the leakage of the toner.

By detachably supporting the upper end section 113 of the body side sheet 103 on the retainer 75, the insertion work of the insertion pieces 123 into the pockets 151 and the drawing work of the insertion pieces 123 from the pockets 151 can be easily performed. However, the lower end section 111 of the body side sheet 103 may be removably supported by the front frame 81, and the upper end section 113 may be fixed to the retainer 75. Alternatively, both the upper end section 113 and the lower end section 111 may be removable.

Alternatively, the pockets may be formed directly on the outer cover 91 of the retainer 75 without providing the fixed side sheet 105. Alternatively, instead of the pocket, slits into which the insertion pieces 123 can be inserted may be formed in the outer cover 91.

Figure 9:
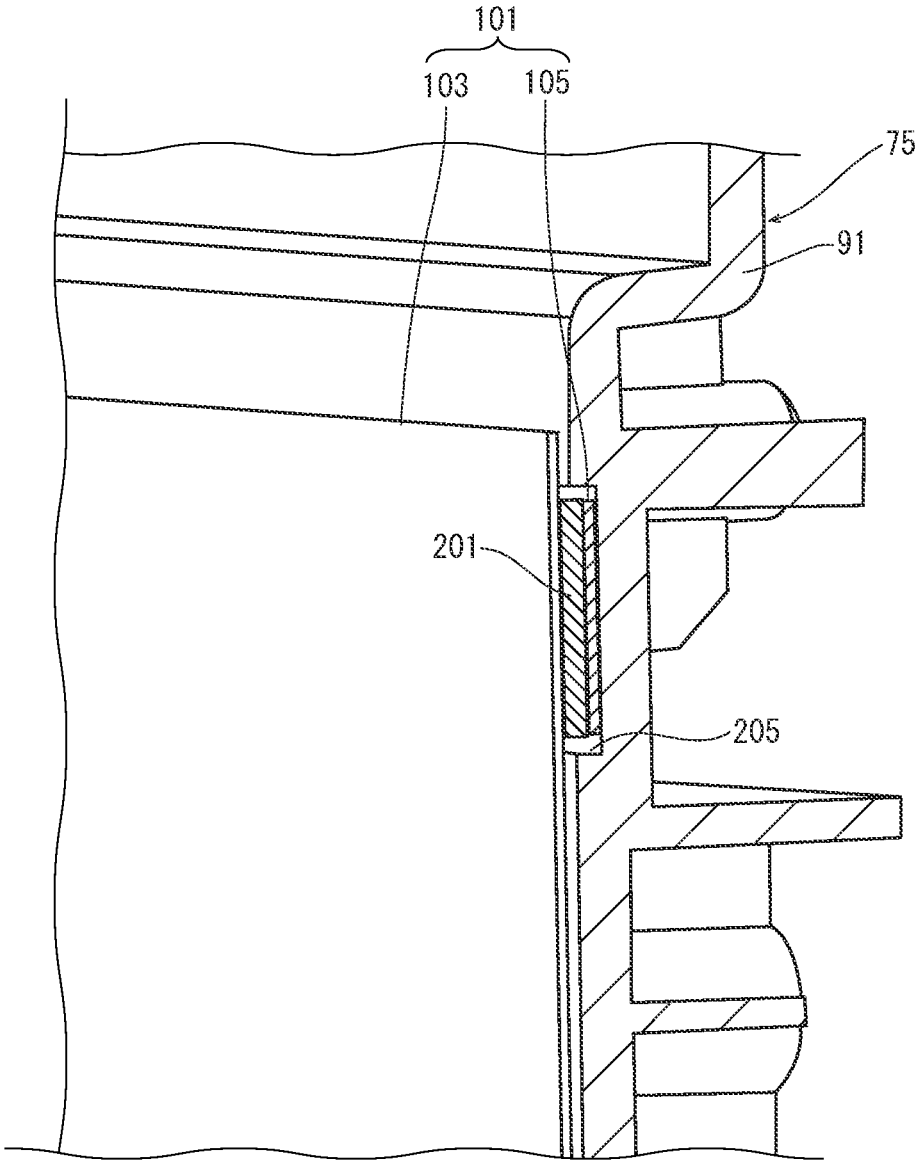
FIG. 9 is a perspective view showing another example of the sheet member, in the image forming apparatus according to the embodiment of the present disclosure.

Next, with reference to FIG. 9, a modified example of the sheet member 101 will be described. FIG. 9 is a perspective view showing the sheet member 101.

The sheet member 101 of the modified example included the body side sheet 103 fixed to the supporting frame 73 and the fixed side sheet 105 fixed to the retainer 75. The upper end section 113 of the body side sheet 103 has a rectangular shape. A magnetic piece 201 is fixed on the inner surface of the upper end section 113 along the left-and-right direction. The fixed side sheet 105 is formed of a metal plate sheet which is magnetically attractable to the magnetic piece 201. On the outer surface of the retainer 75 (the outer cover 91), a groove 205 having a rectangular cross section is formed along the left-and-right direction. The fixed side sheet 105 is fixed in the groove 205.

According to the modified example, the magnetic piece 201 is magnetically attracted to the fixed side sheet 105, so that the upper end section 113 of the body side sheet 103 is fixed to the retainer 75. On the other hand, when the magnetic piece 201 is detached from the fixed side sheet 105 against the magnetic force, the upper end section 113 of the body side sheet 103 is detached from the retainer 75. The metal plate sheet may be fixed to the upper end section 113 of the body side sheet 103, and the fixed side sheet 105 may be formed of a magnet piece.

A method for supporting the upper end section 113 (or the lower end section 111) of the sheet member 101 (the body side sheet 103) to the retainer 75 in a detachable manner may contain a method using a velcro tape (registered trademark), a snap fit coupling and the others.

Although the invention has been described with respect to specific embodiments, the invention is not limited to the above embodiments. Those skilled in the art may modify the embodiments described above without departing from the scope and spirit of the invention.

The invention claimed is:

1. An image forming apparatus comprising:

an image carrier unit including an image carrier on which an electrostatic latent image is formed;

a developing unit which develops the electrostatic latent image formed on the image carrier with toner;

a supporting frame to which the image carrier unit and the developing unit are detachably attached;

a retainer which is supported by the supporting frame in a turnable manner, and positions the image carrier unit and the developing unit to the supporting frame by being turned upward; and a sheet member which closes a gap between the supporting frame and the retainer, wherein the sheet member has an upper section supported by the retainer and a lower end section supported by the supporting frame, and at least one of the upper end section and the lower end section is configured to be detachable.

2. The image forming apparatus according to claim 1, wherein the lower end section of the sheet member is fixed to the supporting frame and the upper end section is detachable from the retainer.

3. The image forming apparatus according to claim 2, wherein the upper section of the sheet member has an insertion piece, and the retainer is provided with a holding member having an insertion hole into which the insertion piece can be fitted.

4. The image forming apparatus according to claim 2, wherein a magnet piece is provided at the upper end section of the sheet member, and the retainer is provided with a sheet metal piece which is attractable to the magnetic piece by a magnetic force of the magnet piece.

5. The image forming apparatus according to claim 2, wherein, the supporting frame includes:

an opening through which the image carrier unit and the developing unit are attachable and detachable, and a horizontal supporting piece provided below the opening and on which the retainer turned downward is supported, wherein the lower end section of the sheet member is fixed to the supporting piece.

6. The image forming apparatus according to claim 5, further comprising:

an exposure device which forms the electrostatic latent image on the image carrier, wherein the supporting frame has a hole through which an adjusting screw for adjusting the exposure device is exposed, below the opening and above the supporting piece.

7. The image forming apparatus according to claim 1, wherein, the upper end section of the sheet member is formed of an elastic resin sheet piece, and the lower end section and an intermediate section between the upper end section and the lower end section are formed of a flexible synthetic leather or a nonwoven fabric sheet piece, and the upper end section and the intermediate section are connected by using an adhesive or suturing.

* * * * *